US006174853B1

(12) United States Patent
Böckh et al.

(10) Patent No.: US 6,174,853 B1
(45) Date of Patent: Jan. 16, 2001

(54) TEXTILE DETERGENT FORMULATION ON THE BASIS OF QUATERNIZED GLYCINE NITRILES, BLEACHING AGENTS, NONIONIC AND/OR ANIONIC TENSIDES AND CALCIUM ION AND/OR MAGNESIUM ION SEQUESTERING COMPOUNDS

(75) Inventors: Dieter Böckh, Limburgerhof; Gregor Schürmann, Schwetzingen; Klaus Mundinger, Limburgerhof; Michael Schönherr, Frankenthal, all of (DE)

(73) Assignee: BASF Aktiengesellschaft, Ludwigshafen (DE)

( * ) Notice: Under 35 U.S.C. 154(b), the term of this patent shall be extended for 0 days.

(21) Appl. No.: 09/308,643

(22) PCT Filed: Nov. 18, 1997

(86) PCT No.: PCT/EP97/06429

§ 371 Date: May 28, 1999

§ 102(e) Date: May 28, 1999

(87) PCT Pub. No.: WO98/23718

PCT Pub. Date: Jun. 4, 1998

(30) Foreign Application Priority Data

Nov. 29, 1996 (DE) ..... 196 49 384

(51) Int. Cl.[7] ..... C11D 1/58; C11D 1/62

(52) U.S. Cl. ..... 510/500; 510/504

(58) Field of Search ..... 510/500, 504

(56) References Cited

U.S. PATENT DOCUMENTS 5,739,327 * 4/1998 Arbogast et al. ..... 544/163

* cited by examiner

*Primary Examiner*—John Hardee
(74) *Attorney, Agent, or Firm*—Oblon, Spivak, McClelland, Maier & Neustadt, P.C.

(57) ABSTRACT

Textile detergent formulation, containing (A) from 0.1 to 10 wt % of quaternized glycine nitriles, (B) from 0.5 to 40 wt % of bleaches in the form of peroxo compounds and/or peracids, (C) from 0.5 to 50 wt % of non-ionic and/or anionic surfactants and (D) from 5 to 85 wt % of compounds that are capable of sequestering calcium and/or magnesium ions.

This formulation is suitable for domestic and commercial laundering of textiles in a dosage of more than 2 g per liter of washing liquor, particularly when using a goods-to-liquor ratio of from 1:10 to 1:2.

8 Claims, No Drawings

TEXTILE DETERGENT FORMULATION ON THE BASIS OF QUATERNIZED GLYCINE NITRILES, BLEACHING AGENTS, NONIONIC AND/OR ANIONIC TENSIDES AND CALCIUM ION AND/OR MAGNESIUM ION SEQUESTERING COMPOUNDS

The present invention relates to a novel textile detergent formulation based on quaternized glycine nitriles acting as bleach activators, bleaches, non-ionic and/or anionic surfactants and compounds capable of sequestering calcium and/or magnesium ions. Furthermore the invention relates to the use of this textile detergent formulation for washing textiles in household and trade using very specific dosages and liquor ratios.

Textile detergent formulations usually contain a bleaching system which mostly consists of active oxygen-donating peroxo compounds, peracids or mixtures thereof and bleach activators. The bleach activator most frequently used is in this case tetraacetylethylene-diamine ("TAED"). However the prior art bleaching systems do not yet show optimum cleaning and soil removing action in commonly used textile detergent formulations, and the values measured for the bleaching action are still unsatisfactory.

The quaternized glycine nitrites involved in the present invention have not yet been described in the published prior art for use as a textile detergent ingredient. WOA 96/07650 describes a process for the preparation of such quaternized glycine nitriles, but said reference makes no mention of possible uses of these compounds.

It as an object of the present invention to provide a textile detergent formulation which attains an optimal washing, cleaning, and bleaching action by the precise tuning of the specific bleaching system used to the remaining components of the formulation.

Accordingly, we have found a textile detergent formulation which contains (A) from 0.1 to 10 wt % of at least one quaternized glycine nitrile of the general formula 1*a* or 1*b*

(Ia)

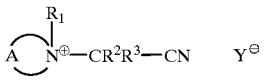

(Ib)

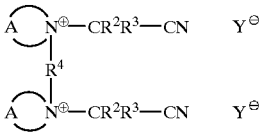

in which

A represents a saturated four-membered to nine-membered ring containing at least one carbon atom and at least one other hetero atom selected from the group comprising oxygen, sulfur and nitrogen, $R^1$ denotes a $C_1$–$C_{24}$ alkyl group, which can be interrupted by non-adjacent oxygen atoms or can additionally carry hydroxyl groups, a $C_4$–$C_{24}$ cycloalkyl group, a $C_7$–$C_{24}$ alkaryl group or a grouping of the formula $CR^2R^3CN$, $R^2$ and $R^3$ independently denote hydrogen, $C_1$–$C_{24}$ alkyl groups, which can be interrupted by non-adjacent oxygen atoms or can additionally carry hydroxyl groups, or denote $C_4$–$C_{24}$ cycloalkyl groups or $C_7$–$C_{24}$ alkaryl groups, $R^4$ denotes a $C_1$–$C_{75}$ alkylene group, which can be interrupted by non-adjacent oxygen and/or sulfur atoms, and $Y^{\ominus}$ stands for a counterion, (B) from 0.5 to 40 wt % of bleach in the form of peroxo compounds and/or peracids, (C) from 0.5 to 50 wt % of non-ionic and/or anionic surfactants in the form of peroxo compounds and/or peracids, (D) from 5 to 85 wt % of at least one compound capable of sequestering calcium and/or magnesium ions.

The preferred amounts for the four named components are:

(A) from 0.5 to 7 wt %, particularly from 1 to 6 wt %

(B) from 5 to 30 wt %, particularly from 10 to 25 wt %

(C) from 5 to 30 wt %, particularly from 10 to 25 wt %

(D) from 10 to 70 wt %, particularly from 15 to 60 wt %, and primarily from 25 to 50 wt %.

Particularly suitable saturated heterocyclic ring structures formed in the compounds 1*a* or 1*b* by A together with the N atom of the glycine framework are those which contain not only the N atom coming from the glycine moiety but also one or two further hetero atoms selected from the group comprising oxygen and nitrogen. Preferred ring sizes are five-, six-, and seven-membered rings. Examples of suitable heterocyclic systems are imidazolodine, 1,2,3-triazolidine and piperazine.

Quaternized glycine nitriles 1*a* or 1*b*, in which A and the N atom of the glycine moiety together form a saturated six-membered ring containing 4 carbon atoms and one oxygen atom, are particularly preferred. This particularly involves morpholine systems.

The radical $R^1$, which is formally and usually in actual fact formed by the alkylation of the N atom, denotes for example a straight-chain or branched-chain longer or, in particular, shorter alkyl radical containing from 1 to 24 carbon atoms, unsaturated radicals, particularly unsaturated fatty acid radicals, also being suitable, eg, methyl, ethyl, propyl, isopropyl, butyl, isobutyl, sec-butyl, tert-butyl, pentyl, hexyl, heptyl, octyl, 2-ethyihexyl, nonyl, isononyl, decyl, undecyl, dodecyl, tridecyl, isotridecyl, myristyl, cetyl, stearyl, or oleyl;

alkoxyalkyl radicals, eg, methoxymethyl, 2-methoxyethyl, 3-methoxypropyl, 4-methoxybutyl, 2-ethoxyethyl, or 3-ethoxypropyl;

hydroxyalkyl radicals, eg, hydroxymethyl, 2-hydroxyethyl, 2-hydroxypropyl, 3-hydroxy2butyl, or 4-hydroxybutyl;

radicals composed of recurring $C_2$–$C_4$ alkylene oxide units such as ethylene oxide, propylene oxide, or butylene oxide, which can be terminated by a hydroxyl group or an alkoxy group, eg, $—(C_2H_4O)_n—H$ or $—(C_2H_4O)_n—R^5$, $—(C_3H_6O)_m—H$, $—(C_3H_6O)_m—R^5$, $—(C_4H_8O)_k—H$, or $—(C_4H_8O)_k—R^5$ (n is 2 to 11, m is 2 to 7, k is 2 to 5, $R^5$ is methyl or ethyl);

cycloalkyl groups such as cyclopentyl, cyclohexyl, or cycloheptyl;

alkaryl groups such as benzyl, 2-phenylethyl, 3-phenylpropyl, or 4-phenylbutyl;

groupings of the formula $—CH_2—CN$, $—CH(CH_3)—CN$, or $—C(CH_3)_2—CN$.

$R^1$ preferably has the following values: $C_1$–$C_4$ alkyl and benzyl.

The values of $R^2$ and $R^3$ are basically the same as those given for $R^1$ (with the exception of $CR^2R^3CN$); $R^2$ and/or $R^3$ can also denote hydrogen; $R^2$ and $R^3$ preferably stand for hydrogen, methyl, and ethyl and in particular, $R^2$ and $R^3$are both hydrogen.

The bridging member $R^4$ in the dimeric compounds 1*b* denotes for example a straight-chain or branched-chain alkylene group containing from 1 to 24 carbon atoms and in particular from 2 to 12 carbon atoms, whilst $C_2$–$C_{12}$ polymethylene groupings such as —$CH_2CH_2$—, —$(CH_2)_4$—, —$(CH_2)_6$—, or —$(CH_2)_8$— are preferred. Other examples of $R^4$ are groupings terminated by alkylene end groups and composed of recurring $C_2$–$C_4$ alkylene oxide units such as ethylene oxide, propylene oxide, or butylene oxide such as —$(C_2H_4O)_p$—$C_2H_4$— or —$(C_3H_6O)_q$—$C_3H_6$— (p is 1 to 36, q is 1 to 24).

A particularly suitable alkylating agent, which is usually responsible for the introduction of the group $R^1$ in the preparation of the compounds 1*a*, is dimethyl sulfate, diethyl sulfate, a methyl or ethyl halide, dimethyl carbonate, diethyl carbonate, methyl tosylate, ethyl tosylate, methyl mesylate, ethyl mesylate, or a benzyl halide. By "halides" we mean chloride, bromide, or iodide. Accordingly preferred values of the counterion $Y^{\ominus}$ are also $CH_3OSO_3^{\ominus}$, $C_2H_5OSO_3^{\ominus}$, $Cl^{\ominus}$, $Br^{\ominus}$, $1^{\ominus}$, $CH_3OCO_2^{\ominus}$, $C_2H_5OCO_2^{\ominus}$, p-tolyl$SO_3^{\ominus}$, and $CH_3SO_3^{\ominus}$. Particular values of $R^1$ are accordingly methyl, ethyl, and benzyl. Dimethyl sulfate is particularly preferred for use as alkylating agent.

Hydrogen sulfate (bisulfate) $HSO_4^{\ominus}$ and/or sulfate $SO_4^{2\ominus}$ (in half of the stoichiometric amount) can also occur as counterion $Y^{\ominus}$, which are partially or completely formed for example in the desired hydrolysis of the compounds 1*a* or 1*b* having alkyl sulfate counterions.

Analogous bifunctional alkylating agents can be used in the preparation of the dimeric compounds 1*b*.

Quaternized glycine nitrites 1*a* that are preferably used as component (A) are those in which $R^1$ denotes a $C_1$–$C_4$ alkyl group or a benzyl radical and $R^2$ and $R^3$ denote hydrogen. The sulfate, methyl sulfate, and/or hydrogen sulfate of N-methylmorpholinium acetonitrile are particularly preferred for use as component (A).

The described quaternized glycine nitrites 1*a* or 1*b* of the component (A) are preferably used as a (granulated) blend with suitable inert porous support materials in the usual ratios. These mixtures or granulated materials may also be shaped. Particularly suitable support materials are those having a large internal surface area (approximately from 10 to 500 $m^2/g$, particularly from 250 to 450 $m^2/g$, as determined by BET) and an average particle size of from 3 nm to 2 mm, particularly from 10 nm to 100 mmm. The support materials are preferably silica gels, silicic acids, aluminum oxides, kaolins, or aluminum silicates An important feature of the textile detergent formulation of the invention is the matching of component (A) to component (D). Representatives selected from the group comprising zeolites, silicates, alkali metal phosphates, polycarboxylates, and aminopolycarboxylates are preferably used as component (D), either alone or in mixtures. The said classes of substances mainly function as builders or co-builders in the textile detergent formulation. According to the present invention the component (D) is present to a relatively high extent in the formulation.

Zeolites and silicates can be basically referred to as inorganic ion exchangers. Suitable zeolites (aluminum silicates) are particularly those of types A, P, X, B, HS, and MAP in their sodium form or in forms in which sodium is partially replaced by other cations such as Li, K, Ca, Mg, or ammonium. Such zeolites are described for example in EP-A 038,591, EP-A 021,491, EP-A 087,035, U.S. Pat. No. 4,604,224, GB-A 2,013,259, EP-A 522,726, EP-A 384,070 and WO-A 94/24251.

Suitable amorphous or crystalline silicates, particularly lamellar silicates, are primarily amorphous disilicates and crystalline disilicates such as the lamellar silicate SKS 6 (sold by Hoechst). The silicates can be used in the form of their alkali metal salts, alkaline earth metal salts, or ammonium salts. Na, Li, and Mg silicates are preferably used.

A particularly suitable alkali metal phosphate is trisodium polyphosphate, which can likewise be regarded as inorganic ion exchanger.

Suitable low molecular weight polycarboxylates and aminopolycarboxylates for use as component (D) are particularly:

- $C_4$–$C_{20}$ dioic, trioic, and tetroic acids such as succinic acid, propanetricarboxylic acid, butanetetracarboxylic acid, cyclopentanetetracarboxylic acid, and alkylsuccinic and alkenylsuccinic acids containing $C_2$–$C_{16}$ alkyl or alkenyl radicals;
- $C_4$–$C_{20}$ hydroxycarboxylic acids such as malic acid, tartaric acid, gluconic acid, glucaric acid, citric acid, lactobionic acid, and saccharosemonoic, saccharosedioic, and saccharosetrioic acid;
- chelating aminopolycarboxylates such as nitrilotriacetic acid, methylglycinediacetic acid, β-alaninediacetic acid, ethylenediaminetetraacetic acid, serinediacetic acid, or ethylenediamine-N,N -disuccinate, preferably in the form of their partially or completely neutralized alkali metal (particularly sodium) salts Suitable oligomers or polymeric polyearboxylates and aminopolycarboxylates for use as component (D) are particularly:

- oligomaleic acids, as described, for example, in EP-A 451,508 and EP-A 396,303;
- copolymers and terpolymers of unsaturated $C_4$–$C_8$ dicarboxylic acids, where the comonomers present in the form of polymerized units can be monoethylenically unsaturated monomers
  - selected from group (i) in amounts ranging up to 95 wt %,
  - selected from group (ii) in amounts ranging up to 60 wt %,
  - selected from group (iii) in amounts ranging up to 20 wt %

Suitable unsaturated $C_4$–$C_8$ dicarboxylic acids are in this case for example maleic acid, fumaric acid, itaconic acid, and citraconic acid. Maleic acid is preferred.

Group (i) comprises monoethylenically unsaturated $C_3$–$C_8$ monocarboxylic acids such as acrylic acid, methacrylic acid, crotonic acid, and vinyl acetic acid. In group (i), preferably acrylic acid and methacrylic acid are used.

Group (ii) comprises monoethylenically unsaturated $C_2$–$C_{22}$ olefins, vinyl alkyl ethers containing $C_1$–$C_8$ alkyl groups, styrene, vinyl esters of $C_1$–$C_8$ carboxylic acids, (meth)acrylamide, and vinyl pyrrolidone. In group (ii), preferably $C_2$–$C_6$ olefins, vinyl alkyl ethers containing $C_1$–$C_4$ alkyl groups, vinyl acetate and vinyl propionate are used.

Group (iii) comprises (meth)acrylates of $C_1$–$C_8$ alcohols, (meth)acrylonitrile, (meth)acrylamides of $C_1$–$C_8$ amines, N-vinylformamide, and vinyl imidazole.

If the polymers of group (ii) contain vinyl esters incorporated as polymerized units, these may, if desired, be partially or completely hydrolyzed to vinyl alcohol structural units. Suitable copolymers and terpolymers are disclosed, for example, in U.S. Pat. No. 3,887,806 and DE-A 4,313,909.

Suitable copolymers of dicarboxylic acids for use as component (D) are primarily:

copolymers of maleic acid and acrylic acid present in proportions by weight of from 10:90 to 95:5, particularly those present in proportions by weight of from 30:70 to 90:10, particularly those having molecular weights ranging from 1,000 to 150,000;

terpolymers of maleic acid, acrylic acid and a vinyl ester of a $C_1$–$C_3$ carboxylic acid present in a ratio by weight of from 10 (maleic acid): 90 (acrylic acid+vinyl ester) to 95 (maleic acid): 5 (acrylic acid+vinyl ester), where the ratio of acrylic acid to vinyl ester, by weight, can vary over a range of from 20:80 to 80:20;

terpolymers of maleic acid, acrylic acid, and vinyl acetate or vinyl propionate present in a ratio by weight of from 20 (maleic acid): 80 (acrylic acid plus vinyl ester) to 90 (maleic acid): 10 (acrylic acid plus vinyl ester), where the ratio of acrylic acid to the vinyl ester, by weight, can vary over a range of from 30:70 to 70:30;

copolymers of maleic acid with $C_2$–$C_8$ olefins present in a molar ratio of from 40:60 to 80:20, where copolymers of maleic acid with ethylene, propylene, or isobutane present in a molar ratio of approximately 50:50 are particularly preferred.

Graft polymers of unsaturated carboxylic acids on low molecular weight hydrocarbons or hydrogenated hydrocarbons, cf U.S. Pat. No. 5,227,446, DE-A 4,415,623 and DE-A 4,313,909, are likewise suitable for use as component (D). Suitable unsaturated carboxylic acids are in this case for example maleic acid, fumaric acid, itaconic acid, citraconic acid, acrylic acid, methacrylic acid, crotonic acid, and vinyl acetic acid, and also mixtures of acrylic acid and maleic acid, which are grafted in amounts of from 40 to 95 wt %, based on the component that is to be grafted.

As a modification, additionally up to 30 wt %, based on the component to be grafted, of further monoethylenically unsaturated monomers can be present in the form of polymerized units. Suitable modifying monomers are the aforementioned monomers of groups (ii) and (iii).

Suitable for use as graft base are degraded polysaccharides such as acid-degraded or enzyme-degraded starches, inulins, or zellulose, polysaccharides degraded by reduction (hydrogenation or hydrogenating amination), such as mannitol, sorbitol, aminosorbitol, and glucamine and also polyalkylene glycols having molecular weights $M_w$ of up to 5,000 such as poly(ethylene glycol)s, poly(ethylene oxide)-block-poly(propylene oxide)s or pol(ethylene oxide)-block-poly(butylene oxide)s, statistical poly(ethylene oxide)-block-poly(propylene oxide)s or poly(ethylene oxide)-block-poly(butylene oxide)s or alkoxylated monobasic or polybasic $C_1$–$C_{22}$ alcohols, cf U.S. Pat. No. 4,746,456.

Of this group grafted degraded or degraded reduced starches and grafted poly(ethylene oxide)s are preferably used, where from 20 to 80 wt % of monomers based on the graft component are used during graft polymerization. A mixture of maleic acid and acrylic acid present in a ratio, by weight, of from 90:10 to 10:90 is preferably used for the grafting operation.

Poly(glyoxylic acid)s for possible use as component (D) are described for example in EP-B 001,004, U.S. Pat. No. 5,399,286, DE-A 4,106,355, and EP-A 656,914. The terminal groups of poly(glyoxylic acid)s can exhibit various structures.

Polyamidocarboxylic acids and modified polyamidocarboxylic acids for possible use as component (D) are disclosed by EP-A 454,126, EP-B 511,037, WO-A 94/01486, and EP-A 581,452.

Poly(aspartic acid) or co-condensates of aspartic acid with further amino acids, $C_4$–$C_{25}$ mono- or di-carboxylic acids and/or $C_4$–$C_{25}$ monoamine or diamines are also preferably used as aminopolycarboxylates for the component (D). We particularly prefer to use poly(aspartic acid)s that have been prepared in phosphorous acids and modified with $C_6$–$C_{22}$ mono- or di-carboxylic acid or with $C_6$–$C_{22}$ monoamines or diamines.

Condensation products of citric acid with hydroxycarboxylic acids or polyhydroxy compounds for use as component (D) are disclosed, eg, by WO-A 93/22362 and WO-A 92/16493. Such condensates containing carboxyl groups usually have molecular weights of up to 10,000, preferably up to 5,000.

We particularly prefer to use, as component (D) in the textile detergent formulation of the invention, from the said classes of substances zeolite A, zeolite P, zeolite X, lamellar silicates, such as SKS 6, trisodium polyphosphate, poly (acrylic acid-co-maleic acid)s (particularly those having a molecular weight of from 10,000 to 100,000), poly(aspartic acid), citric acid, nitrilotriacetic acid, methylglycinediacetic acid, and mixtures thereof.

Particularly interesting mixtures are those containing zeolites and poly(aspartic acid), zeolites, and oligomaleic acids, zeolites, and poly(acrylic acid-co-maleic acid)s, trisodium polyphosphate, and lamellar silicates, trisodium polyphosphate, and poly(acrylic acid-co-maleic acid)s, zeolites, and trisodium polyphosphate and also containing zeolites, lamellar silicates, and poly(acrylic acid-co-maleic acid)s as the respective main ingredients of the component (D).

In addition to the quaternized glycine nitriles 1*a* or 1*b* further bleach activators may also be present in the component (A). Compounds of the the following classes of substances are suitable for this purpose:

Compounds of the following classes of substances are suitable for this purpose:

Polyacylated sugars or sugar derivatives containing $C_1$–$C_{10}$ acyl radicals, preferably acetyl, propionyl, octanoyl, nonanoyl or benzoyl radicals, particularly acetyl radicals, are suitable for use as bleach activators. Mono- or di-saccharides and also their reduced or oxidized derivatives are suitable for use as sugars or sugar derivatives, preferably glucose, mannose, fructose, saccharose, xylose, or lactose. Particularly suitable bleach activators of this class of substances are for example pentaacetyl glucose, xylose tetraacetate, 1-benzoyl-2,3,4,6-tetraacetyl glucose, and 1-octanoyl-2,3,4,6-tetraacetyl glucose.

Further bleach activators which can be used are O-acyloxime esters such as O-acetylacetone oxime, O-benzoylacetone oxime, bis(propylimino)carbonate, or bis (cyclohexylimino)carbonate. Such acylated oximes and oxime esters are described for example in EP-A 028,432 and EP-A 26,704.

Bleach activators which can also be used are N-acyl caprolactams such as N-acetyl caprolactam, N-benzoyl caprolactam, N-octanoyl caprolactam, or carbonyl biscaprolactam.

Further bleach activators which can be used are:

N-diacylated and N,N-tetraacylated amines, eg, N,N,N,N-tetraacetylmethylenediamine and N,N,N,N-tetraacetylethylenediamine (TAED), N,N-diacetylaniline, N,N-diacetyl-p-toluidine, or 1,3-diacylated hydantoins such as 1,3-diacetyl-5,5-dimethyl hydantoin;

N-alkyl-N-sulfonyl carbonamides, eg, N-methyl-N-mesyl acetamide or N-methyl-N-mesyl benzamide;

N-acylated cyclic hydrazides, acylated triazoles or urazoles, eg, monoacetylmaleic hydrazide;

O,N,N-trisubstituted hydroxylamines, eg, O-benzoyl-N,N-succinylhydroxylamine, O-acetyl-N,N-succinyl hyroxylamine, or O,N,N-triacetalhydroxylamine;

N,N-diacyl sulfurylamides, eg, N,N-dimethyl-N,N-diacetyl sulfurylamide or N,N-diethyl-N,N-dipropionyl sulfurylamide;

triacyl cyanurates, eg, triacetyl cyanurate or tribenzoyl cyanurate;

carboxylic anhydrides, eg, benzoic anhydride, m-chlorobenzoic anhydride, or phthalic anhydride;

1,3-diacyl-4,5-diacyloxy imidazolines, eg, 1,3-diacetyl-4,5-diacetoxy imidazoline;

tetraacetyl glycoluril and tetrapropionyl glycoluril;

diacylated 2,5-diketopiperazines, eg, 1,4-diacetyl-2,5-diketopiperazine;

acylation products of propylene diurea and 2,2-dimethylpropylene diurea, eg, tetraacetylpropylene diurea;

α-acyloxy-polyacyl malonamide, eg, α-acetoxy-N,N-diacetyl malonamide;

diacyl-dioxo-hexahydro-1,3,5-triazines, eg, 1,5-diacetyl-2,4-dioxohexahydro-1,3,5-triazine.

Bleach activators which can also be used are 2-alkyl- or 2-aryl-(4H)-3,1-benzoxazin-4-ones, as described, for example, in EP-B 332,294 and EP-B 502,013. 2-phenyl-(4H)-3,1-benzoxazin-4-one and 2-methyl-(4H)-3,1-benzoxa-zin-4-one are particularly useful.

If not only the quaternized glycine nitriles 1*a* or 1*b* but also further bleach activators are present, the aforementioned amounts of the component (A) refer to the total of all of the bleach activators. The compounds 1*a* or 1*b* should amount to however at least 5 wt % and in particular at least 10 wt % of the total of all of the bleach activators. The combination of the compounds 1*a* or 1*b* with TAED is of special interest.

Suitable bleaches of the component (B) are inorganic peroxo compounds which liberate mainly active oxygen. Such peroxo compounds are particularly alkali metal perborates such as sodium perborate tetrahydrate and sodium perborate monohydrate and also alkali metal carbonate perhydrates such as sodium carbonate perhydrate ("sodium percarbonate") and also hydrogen peroxide.

Mostly in addition to these inorganic peroxo compounds the bleaching system of the detergent formulation can contain inorganic or organic peracids, particularly percarboxylic acids, eg, $C_1$–$C_{12}$ percarboxylic acids, $C_8$–$C_{16}$ dipercarboxylic acids, imidopercaproic acids, or aryidipercaproic acids. Preferred examples of useful acids are peracetic acid, linear or branched-chain octane-, nonane-, decane-, or dodecane-monoperoxy acids, decanediperoxy acid and dodecanediperoxy acid, mono and diperphthalic acids, mono and diisophthalic acids, and mono and diterephthalic acids, phthalimidopercaproic acid, and terephthaloyldiamidopercaproic acid. These percarboxylic acids can be used as free acids or as salts of the acids and preferably as alkali metal salts or alkaline earth metal salts .

Other examples of the bleaching system of the textile detergent formulation of the invention can comprise not only the components (A) and (B) but also bleaching catalysts and/or bleach stabilizers.

The bleaching catalysts used are usually quaternized imines or sulfonimines as described, for example, in U.S. Pat. No. 5,360,568, U.S. Pat. No. 5,360,569 and EP-A 453,003 and also manganese complexes as described, for example, in WO-A 94/21777. Other useful metal-containing bleaching catalysts are described in EP-A 458,397, EP-A 458,398 and EP-A 549,272. Bleaching catalysts are usually used in amounts ranging up to 1 wt %, particularly from 0.01 to 0.5 wt %, based on the detergent formulation.

Bleach stabilizers are additives which can adsorb, bind, or complex traces of heavy metals that are a hindrance to bleaching. In particular, usual chelating agents such as ethylenediamine tetraacetate, nitrilotriacetic acid, methylglycinediacetic acid, β-alaninediacetic acid, ethylenediamine-N,N-disuccinate, and phosphonates, such as ethylenediaminetetramethylene phosphonate, diethylenetriamine pentamethyl- ene phosphonate, or hydroxyethylidene-1,1-diphosphonic acid in the form of the acids or as partially or completely neutralized alkali metal salts are used for this purpose in amounts ranging up to 1 wt %, particularly from 0.01 to 0.5 wt %, based on the detergent formulation.

The component (C) used may be any usual non-ionic or anionic surfactant or a mixture thereof.

Suitable anionic surfactants are for example fatty alcohol sulfonates of fatty alcohols containing from 8 to 22, preferably 10 to 18, carbon atoms, eg, $C_9$–$C_{11}$ alcohol sulfates, $C_{12}$–$C_{13}$ alcohol sulfates, cetyl sulfate, myristyl sulfate, palmityl sulfate, stearyl sulfate, and tallow fatty alcohol sulfate.

Other suitable anionic surfactants are sulfated ethoxylated $C_8$–$C_{22}$ alcohols (alkyl ether sulfates) or the soluble salts thereof. Compounds of this type are prepared, for example, by first of all alkoxylating a $C_8$–$C_{22}$ and preferably a $C_{10}$–$C_{18}$ alcohol, eg, a fatty alcohol and subsequently sulfating the alkoxylation product. Preferably ethylene oxide is used for the alkoxylation, from 2 to 50 and preferably from 3 to 20 mol of ethylene oxide being used per mole of fatty alcohol. The alkoxylation of alcohols may alternatively be carried out using propylene oxide alone or optionally together with butylene oxide. In addition alkoxylated $C_8$–$C_{22}$ alcohols containing ethylene oxide and propylene oxide or ethylene oxide and butylene oxide are suitable. The alkoxylated $C_8$–$C_{22}$ alcohols can contain the units of ethylene oxide, propylene oxide, and butylene oxide in the form of blocks or in random distribution.

Other suitable anionic surfactants are alkane sulfonates such as $C_8$–$C_{24}$ and preferably $C_{10}$–$C_{18}$ alkane sulfonates and also soaps such as the salts of $C_8$–$C_{24}$ carboxylic acids.

Other suitable anionic surfactants are $C_9$–$C_{20}$ linear alkylbenzenesulfonates (LAS).

Other suitable anionic surfactants are N-acyl sarcosinates containing aliphatic saturated or unsaturated $C_8$–$C_{25}$ acyl radicals and preferably $C_{10}$–$C_{20}$ acyl radicals, eg, N-oleoyl sarcosinate.

The anionic surfactants are added to the detergent formulation preferably in the form of salts. Suitable cations in these salts are alkali metal ions such as sodium, potassium, and lithium and ammonium ions such as hydroxyethylammonium, di(hydroxyethyl)ammonium, and tri(hydroxyethyl)ammonium ions.

Of the named anionic surfactants linear alkyl benzenesulfonates and fatty alcohol sulfonates are of special interest.

Suitable non-ionic surfactants are for example alkoxylated $C_8$–$C_{22}$ alcohols such as fatty alcohol alkoxylates or oxoalcohol alkoxylates. The alkoxylation can be carried out using ethylene oxide, propylene oxide and/or butylene oxide. Useful surfactants in this case are all alkoxylated alcohols containing at least two is molecules of an aforementioned alkylene oxide as added units. Here again block polymers of ethylene oxide, propylene oxide and/or butylene oxide or addition products which contain the named alkylene oxides in random distribution are suitable. For each mole of alcohol there are usually employed from 2 to 50 and preferably from 3 to 20 moles of at least one alkylene oxide. The alkylene oxide used is preferably ethylene oxide. The alcohols preferably have from 10 to 18 carbon atoms.

A further class of suitable non-ionic surfactants comprises alkylphenol ethoxylates containing $C_6$–$C_{14}$ alkyl chains and from 5 to 30 mol of ethylene oxide units.

Another class of non-ionic surfactants comprises alkylpolyglucosides containing from 8 to 22 and preferably from 10 to 18 carbon atoms in the alkyl chain. These compounds usually contain from 1 to 20 and preferably from 1.1 to 5 glucoside units.

Another class of non-ionic surfactants comprises N-alkyl glucamides of the general formula II or III (II)

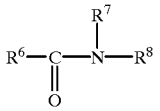

(III)

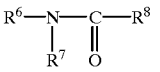

where $R^6$ is $C_6$–$C_{22}$ alkyl, $R^7$ is H or $C_1$–$C_4$ alkyl and $R^8$ is a polyhydroxyalkyl radical containing from 5 to 12 carbon atoms and at least 3 hydroxy groups. $R^6$ is preferably $C_{10}$–$C_{18}$ alkyl, $R^7$ methyl, and $R^8$ a $C_5$ or $C_6$ radical. Such compounds are obtained, for example, by the acylation of reduced aminated sugars with acid chlorides of $C_{10}$–$C_{18}$ carboxylic acids .

The non-ionic surfactants containing from 3 to 12 mol of ethylene oxide contained in the textile detergent formulation of the invention are preferably ethoxylated $C_{10}$–$C_{16}$ alcohols, particularly ethoxylated fatty alcohols and/or ethoxylated oxoalcohols.

Additional components in the textile detergent formulation of the invention can be usual antigraying agents and/or soil releasing polymers in usual amounts (from approximately 0.1 to approximately 2 wt %).

Suitable soil releasing polymers and/or antigraying agents for detergents are for example:

- polyesters of poly(ethylene oxide)s with ethylene glycol and/or propylene glycol and aromatic dicarboxylic acids or aromatic and aliphatic dicarboxylic acids;
- polyesters of poly(ethylene oxide)s that are closed at one end by a terminal group with dihydric and/or polyhydric alcohols and dicarboxylic acid.

Such polyesters are disclosed, for example, in U.S. Pat. No. 3,557,039, GB-A 1,154,730, EP-A 185,427, EP-A 241,984, EP-A 241,985, EP-A 272,033 and U.S. Pat. No. 5,142,020.

Other suitable soil releasing polymers are amphiphilic graft polymers or copolymers of vinyl esters and/or acrylic esters on polyalkylene oxides (cf U.S. Pat. No. 4,746,456, U.S. Pat. No. 4,846,995, DE-A 3,711,299, U.S. Pat. No. 4,904,408, U.S. Pat. No. 4,846,994 and U.S. Pat. No. 4,849,126) or modified celluloses such as methylcellulose, hydroxypropylcellulose or carboxymethylcellulose.

Other additional components in the textile detergent formulation of the invention can be usual dye transfer inhibitors in usual amounts (from approximately 0.1 to approximately 2 wt %).

The dye transfer inhibitors used are for example homopolymers and copolymers of vinyl pyrrolidone, vinyl imidazole, vinyl oxazolidone and 4-vinylpyridine-N-oxide having molecular weights ranging from 15,000 to 100,000 and also cross-linked finely divided polymers based on these monomers. The said use of such polymers is known, cf DE-B 2,232,353, DE-A 2,814,287, DE-A 2,814,329 and DE-A 4,316,023.

Other additional components in the textile detergent formulation of the invention can be usual enzymes (usually shaped) in usual amounts (from approximately 0.1 to approximately 3 wt %).

Suitable enzymes are primarily proteases, lipases, amylases, cellulases, and peroxidases; detergent-optimized enzymes that are active in alkaline medium are preferably used. We particularly prefer to use enzymes which are resistant to bleaches. Examples of suitable proteases are alkalase, savinase, durazyme, and esperase (sold by Novo), maxatase (sold by Int. Biosynthetics Inc.), FN-Base (sold by Genencor) and Opticlean (sold by MCK). Examples of suitable lipases are lipolase and Lipolase Ultra (sold by Novo). Examples of suitable cellulases are carezymes and celluzymes (sold by Novo). Examples of suitable amylases are termamyl and duramyl (sold by Novo).

Other additional components in the textile detergent formulation of the invention can be conventional optical brighteners in usual amounts.

Examples of commonly used anionic optical brighteners are:

- disodium-4,4'-bis(2-diethanolamino-4-anilino-s-triazin-6-ylamino)stilbene-2,2'-disulfonate,
- disodium-4,4'-bis(2-morpholino-4-anilino-s-triazin-6-ylamino)stilbene-2,2'-disulfonate,
- disodium-4,4'-bis(2,4-dianilino-s-triazin-6-ylamino) stilbene-2,2'-disulfonate,
- monosodium-4,',4"-bis(2,4-dianilino-s-triazin-6-ylamino) stilbene-2-sulfonate,
- disodium-4,4'-bis(2-anilino-4(N-methyl-N-2-hydroxyethylamino)-s-triazin-6-yl-amino)stilbene-2, 2'-sulfonate,
- disodium-4,4'-bis(4-phenyl-2,1,3-triazol-2-yl)stilbene-2, 2'-disulfonate,
- disodium-4,4'-bis(2-anilino-4(1-methyl-2-hydroxyethylamino)-s-triazin-6-yl-amino)stilbene-2, 2'-disulfonate, and
- sodium-2-(stilbyl-4"(naphtho-1',2',4,5)-1 ,2,3-triazol)-2-sulfonate.

Furthermore, the textile detergent formulation of the invention can contain alkaline additives, particularly sodium carbonate and/or sodium bicarbonate, in amounts of up to 40 wt % and in particular amounts of from 1 to 25 wt %, and also set-up agents, particularly alkali metal sulfates such as sodium sulfate in amounts of up to 60 wt % and in particular amounts of from 1 to 30 wt %.

Other additives for the textile detergent formulation of the invention can be: foam suppressants, corrosion inhibitors, clays, bactericides, phosphonates, abrasives, dyes and also encapsulated and non-encapsulated perfumes.

The textile detergent formulation of the invention preferably exists in the form of a powder or granules having a bulk density of from 200 to 1,100 g/L. Alternatively, liquid formulations are possible.

The textile detergent formulation of the invention can contain the compounds 1*a* or 1*b* incorporated in such a manner that the compounds 1*a* or 1*b* are present as pure components or as components that are premixed with suitable additives and are distributed in the powder or granules of the detergent, or in such a manner that the compounds 1*a* or 1*b* are present as pure components or as components that are premixed with suitable additives and have the form of pulverulent or granulated material that is separate from the remaining detergent ingredients. The incorporation of compounds 1*a* or 1*b* as separate pulverulent or granulated material, particularly as a product premixed with suitable additives, permits careful preparation of detergents showing particularly good stability of the bleach activator.

Non-compacted pulverulent or granulated detergents possess a lower bulk density, usually of from 200 to 600 g/L. They can contain a phosphate-based builder system, or can be reduced-phosphate or non-phosphate systems.

Compositions, in percentages by weight, of non-compacted pulverulent or granulated detergents according to the present invention:

Phosphate-based heavy-duty detergents possess for example the following composition:

from 15 to 60% of phosphate, preferably trisodium polyphosphate from 5 to 35% of surfactants from 0.5 to 6% of compounds 1*a* or 1*b* from 5 to 25% of inorganic peroxo compounds as bleaches from 5 to 50% of set-up agents, preferably sodium sulfate ad 100% of other ingredients.

Detergents of this type are usually used in a dosage of from 4 to 15 g/L.

Reduced-phosphate heavy-duty detergents possess for example the following composition:

from 0.5 to 40% of phosphate, preferably trisodium polyphosphate from 2 to 20% of zeolites, lamellar silicates, polycarboxylates or aminopolycarboxylates or mixtures thereof from 5 to 35% of surfactants from 0.5 to 6% of compounds 1*a* or 1*b* from 5 to 25% of inorganic peroxo compounds as bleach from 5 to 50% of set-up agents, preferably sodium sulfate ad 100% of other ingredients.

Detergents of this type are usually used in a dosage of from 4 to 15 g/L.

Non-phosphate heavy-duty detergents possess for example the following composition:

from 15 to 70% of zeolites, lamellar silicates, polycarboxylates or aminopolycarboxylates or mixtures thereof from 5 to 35% of surfactants from 0.5 to 6% of compounds 1*a* or 1*b* from 5 to 25% of inorganic peroxo compounds as bleach from 5 to 50% of set-up agents, preferably sodium sulfate ad 100% of other ingredients.

Detergents of this type are usually used in a dosage of from 4 to 15 g/L.

Compact detergents possess a high bulk density, usually of from 550 to 1100 g/l. They can possess a phosphate-based builder system, or can be reduced-phosphate or non-phosphate systems.

Compositions, in percentages by weight, of compacted pulverulent or granulated detergents according to the present invention:

Phosphate-based compact detergents possess for example the following composition:

from 10 to 60% of phosphate, preferably trisodium polyphosphate from 5 to 35% of surfactants from 0.5 to 6% of compounds 1*a* or 1*b* from 10 to 25% of inorganic peroxo compounds as bleaches ad 100% of other ingredients.

Detergents of this type are usually used in a dosage of from 2.5 to 7 g/L.

Reduced-phosphate compact detergents possess for example the following composition:

from 2 to 40% of phosphate, preferably trisodium polyphosphate from 2 to 20% of zeolites, lamellar silicates, polycarboxylates or aminopolycarboxylates or mixtures thereof from 5 to 35% of surfactants from 0.5 to 6% of compounds 1*a* or 1*b* from 10 to 25% of inorganic peroxo compounds as bleaches ad 100 of other ingredients.

Detergents of this type are usually used in a dosage of from 2.5 to 7 g/L.

Non-phosphate compact detergents possess for example the following composition:

from 15 to 70% of zeolites, lamellar silicates, polycarboxylates or aminopolycarboxylates or mixtures thereof from 5 to 35% of surfactants from 0.5 to 6% of compounds 1*a* or 1*b* from 10 to 25% of inorganic peroxo compounds as bleaches ad 100% of other ingredients.

Detergents of this type are usually used in a dosage of from 2.5 to 7 g/L.

The textile detergent formulation of the invention is extremely well suited for domestic and commercial laundering of textiles under washing conditions as usually employed in Europe, ie using high detergent dosages and low (short) liquor ratios. For this reason, the use of the textile detergent formulation of the invention in a dosage of more than 2 g per liter of washing liquor and preferably a dosage of from 2.5 to 15 g per liter of washing liquor for the domestic and commercial laundering of textiles is also subject of the present invention. This use preferably takes place at a goods to washing liquor ratio of from 1:10 to 1:2 and preferably of from 1:5to 1:3.

Using the textile detergent formulation of the invention, in particular, a significantly improved bleaching action is attained, particularly also at low washing temperatures of from 20° to 60° C., this being shown by appropriate comparisons with the bleach activator TAED that is usually employed. The textile detergent formulation of the invention is substantially insensitive to hard water, particularly water hardnesses above 2 mmol of $Ca^{2\ominus}$/L.

The use of the textile detergent formulation of the invention produces high contents of active oxygen in the washing liquor, which also contributes to the good washing results. Common active oxygen contents are in this case from 100 to 320 ppm and in particular from 140 to 280 ppm.

Application examples relating to the bleaching action of the textile detergent formulation of the invention The activity of compounds of the structure 1*a* or 1*b* was tested with reference to N-methylmorpholinium acetonitrile in the form of the methyl sulfate salt ("MMA"). The bleaching action was determined in the detergent formulations III and IV (cf Tables 1 and 2).

Tables 1 and 2 give examples of the textile detergent formulation of the invention.

TABLE 1

Compositions of detergent formulations of the invention (in percent by weight)

| | I | II | III | IV | V | VI | VII |
|---|---|---|---|---|---|---|---|
| Na perborate monohydrate | 15.0 | 20.0 | | | 15.0 | | 7.5 |
| Na percarbonate | | | 18.0 | 15.0 | | 18.0 | |
| MMA | 4.0 | 2.0 | 5.0 | 5.0 | 2.9 | 4.2 | 1.0 |
| TEAD | | 3.0 | | | | | 2.0 |
| linear alkylbenzene sulfonate Na salt | 3.1 | 1.7 | 0.8 | | | 6.5 | |
| sodium salt of fatty alcohol sulfate | | 6.0 | 12.0 | 6.0 | 5.5 | | |
| soap | 2.8 | 0.6 | 0.4 | 2.5 | 1.5 | | 2.4 |
| $C_{13}/C_{15}$ oxo-alcohol *3 EO | | 3.0 | | | | | |
| $C_{13}/C_{15}$ oxo-alcohol *7 EO | 4.7 | | 4.7 | 13.5 | 4.0 | 6.5 | 10.0 |
| $C_{18}/C_{18}$ fatty alcohol *10 EO | | 3.0 | | | | | |
| trisodium polyphosphate | | | | | | | 2.0 |
| zeolite A | 25.0 | 25.0 | 15.0 | | 38.0 | 15.0 | |
| zeolite P | | | | 40.0 | | | |
| zeolite X | | | | | | | 35.0 |
| crystalline lamellar silicate | | | 14.0 | | | | |
| amorphous lamellar silicate | | | | | | 15.0 | |
| AA/MA (M 70,000) | | | 5.0 | | | | |
| AA/MA (M 10,000) | | | | | | | 5.0 |
| M/MA/VAC (M 20,000) | | | | | | 5.0 | |
| oligomaleic acid | | | | | 5.0 | | |
| poly(aspartic acid) | 7.5 | | | | | | |
| Na disilicate | 2.5 | 3.9 | | 0.5 | 4.5 | | 1.5 |
| 25 Mg silicate | 1.0 | | 0.8 | | 1.0 | 1.0 | 0.6 |
| sodium sulfate | 15.0 | 2.5 | 3.2 | 2.0 | 1.5 | 5.5 | 3.4 |
| sodium bicarbonate | | | 9.0 | 6.5 | | | |
| sodium carbonate | 12.0 | 13.6 | | | 10.0 | 8.0 | 9.8 |
| citric acid | | 6.8 | 5.0 | | | 2.5 | 3.8 |
| 30 PVP (K-value 30) | 1.5 | | | | | | |
| VI/VP copolymer (K-value 30) | | 1.0 | | | | 0.6 | |
| VI/VP copolymer cross-linked | | | | | | | 1.0 |
| soil releasing polymer 1 | | 0.4 | | | 0.5 | | |
| soil releasing polymer 2 | 1.0 | | | | 0.5 | 0.8 | 1.0 |
| carboxymethylcellulose | 0.6 | 1.3 | 0.6 | 1.0 | 0.6 | 0.6 | 0.5 |
| Dequest ® 2046 | 0.8 | 0.4 | | 0.5 | 0.5 | 1.0 | 0.5 |
| lipase | | | | | 1.0 | | |
| protease | | 1.0 | | | 1.0 | 0.5 | 0.6 |
| cellulase | | | | | | | 0.6 |
| water | to 100 | to 100 | to 100 | to 100 | to 100 | to 100 | to 100 |

TABLE 2

Compositions of detergent formulations of the invention (in percent by weight)

| | VIII | IX | X | XI | XII | XIII | XIV |
|---|---|---|---|---|---|---|---|
| Na perborate monohydrate | | 8.0 | 20.0 | 18.0 | 20.0 | | |
| Na percarbonate | 18.0 | | | | | 20.0 | 25.0 |
| MMA | 4.0 | 1.5 | 1.0 | 3.0 | 3.0 | 4.0 | 6.0 |
| TEAD | | | 4.0 | | | | |
| linear alkylbenzene sulfonate Na salt | 8.0 | 7.0 | 10.0 | 18.0 | 20.0 | | 14.0 |
| sodium salt of fatty alcohol sulfate | 3.0 | 2.0 | | | | 10.0 | |
| $C_{13}/C_{15}$ oxo-alcohol 3 EO | | | | | | 4.0 | |
| $C_{13}/C_{15}$ oxo-alcohol 7 EO | 6.0 | | | 2.0 | | | 8.0 |
| $C_{18}/C_{18}$ fatty alcohol 11 EO | | | 5.0 | | | | |
| glucamide | | | | | | 1.5 | |
| alkylpolyglycoside | | | | | | | 1.0 |
| trisodium polyphosphate | 3.0 | 30.0 | 20.0 | 23.0 | 15.0 | | |
| zeolite A | 30.0 | | | | 10.0 | 20.0 | 18.0 |
| crystalline lamellar silicate | | | | | | 10.0 | |
| amorphous lamellar silicate | | | | | | | 10.0 |
| AA/MA (M 70,000) | 2.0 | | 5.0 | | 1.0 | 5.0 | 4.0 |
| Na disilicate | 3.0 | 1.0 | 6.0 | 8.0 | 6.0 | | 3.0 |
| Mg silicate | | | 1.2 | | | | |
| sodium sulfate | 3.0 | 22.0 | 15.0 | 8.0 | 16.0 | 8.0 | |
| sodium bicarbonate | | 7.0 | | | | | |
| sodium carbonate | 15.0 | 2.0 | 5.0 | 16.0 | 6.0 | 6.0 | |
| citric acid | | 10.0 | | | | 5.0 | |
| PVP (K-value 30) | 0.5 | | | | | | |
| VI/VP copolymer (K-value 30) | | 1.0 | | | | | |
| VI/VP copolymer cross-linked | | | | | | | 1.0 |
| soil releasing polymer 1 | | | | 0.4 | | | |
| soil releasing polymer 2 | | | 1.0 | | | | 0.8 |
| carboxymethylcellulose | 1.0 | | 1.0 | 0.3 | | 1.5 | 0.5 |
| Dequest ® 2046 | 0.8 | 1.0 | 0.8 | 0.5 | 0.6 | | |
| lipase | 0.5 | 0.5 | | | | 0.5 | |
| protease | 0.5 | | | 0.5 | | 0.5 | |
| cellulase | | 0.8 | | | | | |
| water | to 100 | to 100 | to 100 | to 100 | to 100 | to 100 | to 100 |

AA = acrylic acid
PVP = poly(vinyl pyrrolidone)
MA = maleic acid
VI = vinyl imidazole
VAc = vinyl acetate
VP = vinyl pyrrolidone
soil releasing polymer 1 = graft polymer of vinyl acetate on poly(ethylene glycole) (mol. wt. 6000) mol. wt. of graft polymer = 24000
soil releasing polymer 2 = poly(ethylene terephthalate/poly(oxyethylene terephthalate) (mol. wt. 8000)
Dequest ® = ethylenediamine-N,N,N',N'-tetra(methylene phosphonate)

The test took place in an Atlas Standard Launder-O-meter under the conditions specified in Table 3.

TABLE 3

| apparatus | Launder-O-meter |
|---|---|
| cycles | 1 |
| duration | 30 min |
| temperatures | 22° C. and 38° C. |
| water hardness | 3.0 mmol/L |
| test fabrics | 2.5 g in each case of cotton test fabrics stained with tea, red wine, and chlorophyll/oil, additionally 5.0 g of cotton ballast fabric |
| volume of liquor | 250 ml |
| liquor ratio | 1:20 |
| detergents | Nos. III and IV in Table 1 |
| detergent concentration | 4.5 g/L |

Measurement of the color strength of the test fabrics was effected photometrically. The reflectance values obtained on each of the test fabrics at 16 wavelengths ranging from 400 to 700 nm at intervals of 20 nm were used to determine the color strengths of the test stains before and after washing by the method described by A. Kud in "Seifen, Öle, Fette, Wachse 119" pp. 590–594 (1993), from which the absolute percentage bleaching action $A_{abs}$ was calculated.

TABLE 4

Results of washing tests carried out using detergents III or IV at a temperature of 22° C. (the numerical values denote the absolute percentage bleaching action $A_{abs}$)

| Bleach activator | Detergent formulation | Tea | Red wine | Chlorophyll/oil |
|---|---|---|---|---|
| MMA | III | 81.2 | 83.5 | 17.2 |
| none | III | 29.9 | 62.6 | 11.0 |
| TAED | III | 55.6 | 73.3 | 14.3 |
| MMA | IV | 70.0 | 74.7 | 13.4 |
| none | IV | 16.5 | 47.4 | 8.1 |
| TAED | IV | 37.2 | 61.7 | 10.2 |

TABLE 5

Results of washing tests carried out using detergents III or IV at a temperature of 38° C. (the numerical values denote the absolute percentage bleaching action $A_{abs}$)

| Bleach activator | Detergent formulation | Tea | Red wine | Chlorophyll/oil |
|---|---|---|---|---|
| MMA | III | 81.6 | 89.3 | 22.8 |
| none | III | 44.9 | 70.8 | 15.4 |
| TAED | III | 77.1 | 89.2 | 20.4 |
| MMA | IV | 70.4 | 79.5 | 19.3 |
| none | IV | 28.5 | 52.2 | 10.9 |
| TAED | IV | 66.0 | 76.5 | 17.0 |

The results of the washing tests using MMA show that the bleach activator in the formulations III and IV that are tested by way of example exhibits an excellent bleaching action at a detergent dosage of 4.5 g/l over a low temperature range. Compared with TAED improvements result in the case of both hydrophilic and hydrophobic soiling.

In experiments employing a liquor ratio of 1:4 in a standard domestic washing machine it has been found that the bleaching action of the aforementioned tests carried out in accordance with a model in a Launder-O-meter using a long liquor ratio gives results which are comparable to the experiments carried out in said domestic washing machine using a short liquor ratio.

We claim:

1. A textile detergent formulation, comprising:

(A) from 0.1 to 10% by weight of the sulfate, methyl sulfate or hydrogen sulfate of N-methylmorpholinium acetonitrile, (B) from 0.5 to 40% by weight of bleaches in the form of peroxo compounds and/or peracids, (C) from 0.5 to 50% by weight of nonionic and/or anionic surfactants, and (D) from 5 to 85% by weight of at least one compound which sequesters calcium and/or magnesium ions and functions as a builder or co-builder.

2. A textile detergent formulation as claimed in claim 1, comprising:

(A) from 0.5 to 7% by weight of the sulfate, methyl sulfate or hydrogen sulfate of N-methylmorpholinium acetonitrile, (B) from 5 to 30% by weight of bleaches in the form of peroxo compounds and/or peracids, (C) from 5 to 30% by weight of nonionic and/or anionic surfactants, and (D) from 10 to 70% by weight of at least one compound which sequesters calcium and/or magnesium ions.

3. A textile detergent formulation as claimed in claim 1, comprising, as component (D), zeolites, silicates, alkali metal phosphates, polycarboxylates and/or aminopolycarboxylates.

4. A textile detergent formulation as claimed in claim 1, in pulverulent or granular form having a bulk density of from 200 to 1100 g/l.

5. A method of washing textiles for domestic and commercial use, which comprises using a textile detergent formulation as claimed in claim 1 in a concentration of more than 2 g per liter of wash liquor.

6. A method as claimed in claim 5, wherein the liquor ratio of textile material to wash liquor is from 1:10 to 1:2.

7. A method as claimed in claim 5, wherein the concentration of the textile detergent formulation in the wash liquor is 2.5 to 15 g per liter of wash liquor.

8. A method as claimed in claim 5, wherein the liquor ratio of textile material to wash liquor is from 1:5 to 1:3.

* * * * *